US006609489B1

(12) United States Patent
Slopsema et al.

(10) Patent No.: US 6,609,489 B1
(45) Date of Patent: Aug. 26, 2003

(54) APPARATUS AND METHOD FOR REDUCING ENGINE NOISE

(75) Inventors: Thomas Alan Slopsema, Holt, MI (US); Gary Lee Martinson, Dewitt, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/140,914

(22) Filed: May 7, 2002

(51) Int. Cl.[7] ..... F02M 35/10
(52) U.S. Cl. ..... 123/184.57; 181/250; 181/229
(58) Field of Search ..... 123/184.55, 184.57; 181/250, 224, 229

(56) References Cited

U.S. PATENT DOCUMENTS 4,513,699 A 4/1985 Cser ..... 123/52 MB
4,546,733 A 10/1985 Fukami et al. ..... 123/52 MB
5,628,287 A 5/1997 Brackett et al. ..... 123/184.55
6,205,968 B1 3/2001 Spannbauer ..... 123/184.57
6,494,290 B1 * 12/2002 Jessberger ..... 209/397

* cited by examiner

*Primary Examiner*—Tony M. Argenbright
*Assistant Examiner*—Katrina B. Harris
(74) *Attorney, Agent, or Firm*—Leslie C. Hodges

(57) ABSTRACT

A side-branch resonator which has a resonator chamber connected to an air intake pipe with two necks. The necks extend into the resonator chamber and provide a conduit for sound to travel to and from the air intake pipe. The presence of two necks increases the magnitude of attenuation at the resonant frequency and the bandwidth of attenuation of other lower frequency engine noises. The two necks also effectively attenuate higher frequencies by utilizing standing waves found within the resonator chamber.

17 Claims, 4 Drawing Sheets

APPARATUS AND METHOD FOR REDUCING ENGINE NOISE

TECHNICAL FIELD

The present invention relates to an apparatus and method for reducing engine noise.

BACKGROUND OF THE INVENTION

Four- and five-cylinder engines, used on many vehicles today, have inherently loud low frequency induction noise. The objectionable induction system noise on these engines typically occurs at frequencies of 250 Hertz or less. For example, a four-cylinder engine operating at 3000 revolutions per minute (RPM) generates induction system noise at its fundamental firing frequency: 100 Hertz (Hz). This is twice the frequency of the engine RPM, and is accordingly termed "second-order " noise. The range of expected induction noise frequencies is based on the expected engine speeds. In the case of a four-cylinder engine, operating at 1500–6000 RPM, the second-order induction noise frequencies range from 50–200 Hz. Larger engines typically generate induction noise of somewhat higher fundamental frequencies, but even these frequency ranges are relatively low—e.g., a five-cylinder engine generates 2.5 order noise, which at 3000 RPM is 125 Hz.

Various methods are employed to reduce the induction system noise, the most common of which is to use a Helmholtz resonator on the engine air intake pipe. A Helmholtz resonator includes a chamber having a small opening, typically a tube or "neck". The neck is connected to the engine air intake pipe, since it is this pipe through which much of the engine noise escapes. The sound waves (noise waves) generated by the engine travel along the intake pipe where their acoustic pressure impinges on the resonator opening. This acoustic pressure excites a mass of air in the resonator neck, causing high acoustic pressures within the resonator chamber at the resonant frequency. The chamber acoustic pressure reacting back against the air mass in the neck produces out-of-phase acoustic pressures at the intake pipe to cause full cancellation of intake noise at the resonant frequency. In this way, much of the engine noise is eliminated as the out-of-phase acoustic pressures in the intake pipe cancel each other. In order for there to be complete cancellation, the incident and reflected acoustic pressure frequencies must be equal; otherwise, there is only partial cancellation and unwanted noise escapes the intake pipe. In addition, even if the incident and reflected acoustic pressures are of equal frequency, the level or amplitude of the reflected pressures may not be enough to cancel those of the intake pipe noise waves. The frequency at which the attenuating acoustic pressures reach their maximum amplitude is known as the resonant frequency.

Because the amplitude of the attenuating acoustic pressures is very high at the resonant frequency, it is possible to attenuate even very loud noise at this frequency. One of the limitations of a Helmholtz resonator is that it operates at a single, fixed resonant frequency. Thus, very loud noise at other frequencies is not as effectively attenuated. This means that although noise not at the resonant frequency can be reduced, it cannot be completely canceled if it is very loud. The resonator attenuating acoustic pressures do have a range of frequencies, known as bandwidth, over which they operate. They are most effective at the resonant frequency, where their amplitude is highest. The effectiveness of the attenuation quickly tapers off, however, at frequencies on either side of this peak.

A number of parameters determine the resonant frequency and bandwidth of a Helmholtz resonator, including the chamber volume and the neck length and neck area. In general, increasing the chamber volume increases both the magnitude of the attenuation (the amplitude of the attenuating acoustic pressures) and the bandwidth. It is impracticable to increase the chamber volume beyond a certain size, since vehicle packaging requirements limit the available space. Increasing the cross-sectional area of the neck is another way to increase the magnitude of the attenuation; however, the neck area is typically limited by the diameter of the intake pipe into which it connects.

An often undesirable effect of increasing the neck area is that the resonant frequency is increased such that it no longer equals the frequency of the engine noise being targeted. To counteract this resonant frequency shift, the neck length is increased to drive resonance back to the target frequency; however, longer necks can narrow the resonator's attenuation bandwidth. The neck length is, of course, constrained by packaging requirements, so the ability of a designer to vary this parameter is also limited. Moreover, even if all of the parameters are optimized such that the resonant frequency cancels the targeted engine noise frequency, the bandwidth of attenuation is often too small to adequately reduce other noise frequencies generated at different operating speeds.

One way to deal with the limitations inherent in Helmholtz resonators is to create an "active " resonator—i.e., one that changes certain parameters as engine operating conditions change. One such example is found in U.S. Pat. No. 4,546,733 issued to Fukami, et al. on Oct. 15, 1985. Fukami teaches an induction system resonator having a rotary switch valve driven by an actuator that is controlled by a computer. As the engine speed changes, the predominant frequency of the noise is calculated. The computer outputs a driving signal to the actuator, which in turn rotates the rotary switch valve to appropriately adjust the resonant frequency of the resonator. Although active resonators such as this have the advantage of a variable resonant frequency, they are much more complex and therefore much more expensive than fixed frequency resonators. Thus, neither an active resonator, nor the current Helmholtz resonators, provide a low cost solution to the problem of attenuating induction system noise at a range of engine speeds.

Accordingly, it is desirable to provide a simple, low cost noise attenuation apparatus which overcomes the shortcomings of the above-referenced prior art by providing attenuation of sufficient magnitude at a pre-fixed resonant frequency, and a bandwidth of sufficient range, to adequately attenuate engine noise without the need for active, computer driven controls. It is also desired to provide a method for tuning the apparatus to target a specific noise frequency, while increasing the bandwidth over that of conventional Helmholtz resonators.

SUMMARY OF THE INVENTION

One aspect of the present invention provides an improved fixed frequency noise attenuation apparatus that has a higher magnitude of attenuation than conventional fixed-frequency resonators.

Another aspect of the invention provides an improved noise attenuation apparatus with a large bandwidth to effectively attenuate engine noise over a range of frequencies, without using active, computer driven controls.

A further aspect of the invention provides a method of tuning the improved noise attenuation apparatus by varying certain dimensional parameters of the apparatus, such that noise attenuation is optimized for a particular application.

Accordingly, a noise attenuation apparatus for attenuating noise from an engine having a fluid-carrying conduit is provided, which includes a resonator chamber and a plurality of connecting tubes adapted for disposition between the fluid-carrying conduit and the resonator chamber for facilitating sound transfer between the fluid-carrying conduit and the chamber.

In another aspect of the present invention, the fluid-carrying conduit is an air intake pipe, and the plurality of connecting tubes are two cylindrical necks, normal to the intake pipe and parallel to each other.

It is a further aspect of the invention to provide an induction system resonator for attenuating noise from an engine having an intake pipe that comprises a resonator chamber and a plurality of connecting tubes of approximately equal length. Each tube includes an intake end adapted for opening into the intake pipe, and a chamber end opening into the resonator chamber.

In yet another aspect of the invention, a method of attenuating noise from an engine having a fluid-carrying conduit using a noise attenuation apparatus, includes providing a resonator chamber with a generally cylindrical first tube disposed between the resonator chamber and the fluid-carrying conduit for attenuating the engine noise. The method further includes tuning the noise attenuating apparatus to target specific engine noise frequencies by providing the resonator chamber with a generally cylindrical second tube having a length approximately equal to the first tube, and disposed between the resonator chamber and the fluid-carrying conduit at a certain distance from the first tube.

The above object and other objects, features, and advantages of the present invention are readily apparent from the following detailed description of the best modes for carrying out the invention when taken in connection with the accompanying drawings.

DESCRIPTION OF THE PREFERRED EMBODIMENT

Figure 1:
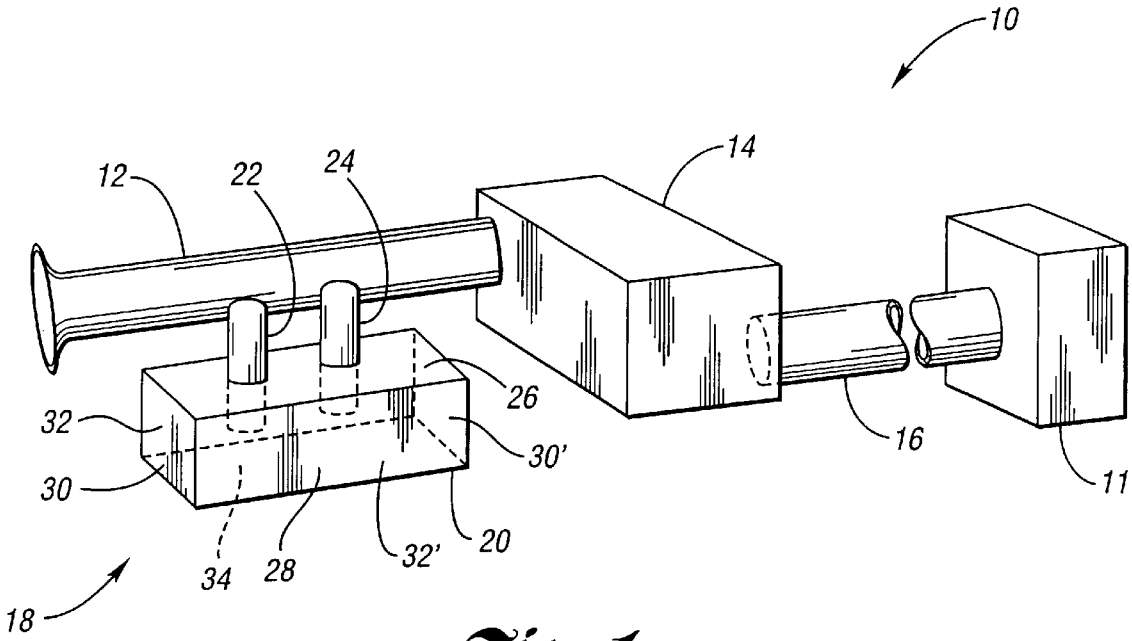
FIG. 1 is a perspective view of a dual-neck resonator attached to the air intake pipe of a vehicle engine, just before the intake pipe enters an air cleaner.

FIG. 1 shows a portion of an air induction system 10 for a vehicle engine 11. An air intake pipe 12 takes in outside air which is then filtered in an air cleaner 14 before entering an outlet pipe 16 on its way to the engine 11. The engine may generate a great deal of noise, much of which can escape through the air intake pipe 12. To help eliminate or reduce the amount of engine noise that escapes, a resonator 18 is attached to the air intake pipe 12. The resonator 18 comprises a rectangular resonator chamber 20 and two cylindrical necks 22, 24. The resonator chamber 20 includes a top 26, a bottom 28, end walls 30, 30' and side walls 32, 32', all orthogonally oriented to each other. The necks 22, 24 are approximately normal to the intake pipe 12 and extend, as shown in phantom, into an inner space 34 of the resonator chamber 20.

The resonator 18 attenuates the engine noise prior to its escaping through the air intake pipe 12 by providing a system by which at least some of the engine noise wave content is canceled by attenuating acoustic pressures of similar frequency that are out of phase with the corresponding acoustic pressures of the engine noise waves. The engine noise acoustic pressures in the intake pipe 12 impinge on, and cause excitation of, an air mass in both necks 22, 24 at the resonant frequency. This air mass motion causes amplified acoustic pressures within the inner space 34 of the chamber 20, which act against, and are bounded by, the chamber walls 26, 28, 30, 30', 32, and 32'. These high acoustic pressures in the inner space 34 subsequently react back against the air mass in the necks 22, 24, creating attenuation acoustic pressures in the intake pipe 12 which are out of phase with the original engine noise acoustic pressures. This action occurs at the resonant frequency. These out-of-phase source and attenuation acoustic pressures combine to interfere with each other, resulting in at least partial cancellation of sound pressures, depending on their respective pressure magnitudes. This results in less noise escaping the air intake pipe 12.

Because vehicle engines may generate noise at many different frequencies as they operate, an effective resonator must be able to attenuate noise that occurs at a large range of frequencies. A side-branch resonator such as 18 shown in FIG. 1, is a "fixed-frequency " type resonator. This means that although there is a range of noise frequencies that such a resonator will attenuate, it has only one resonant frequency. The resonant frequency is important because it is at this frequency that a resonator reaches its highest level of attenuation. This means that even very loud noise is effectively attenuated, if that noise is at the resonant frequency of the resonator. This is in contrast to loud noise that enters a resonator at frequencies other than the resonant frequency. Noise of this type is attenuated far less effectively. It is therefore important to construct a Helmholtz-type resonator with the proper geometry such that its resonant frequency matches the frequency of the most undesirable engine noise.

Figure 2:
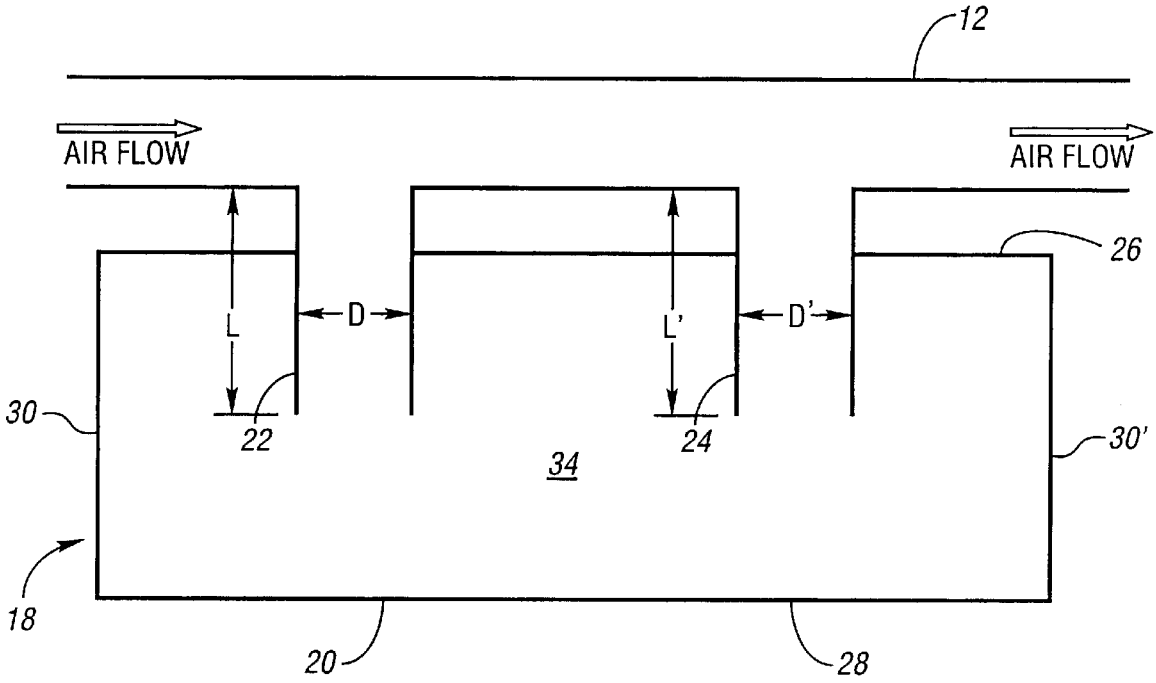
FIG. 2 is a fragmentary schematic cross-section and dimensions of the inlet duct, resonator necks, and resonator chamber shown in FIG. 1.
Figure 3:
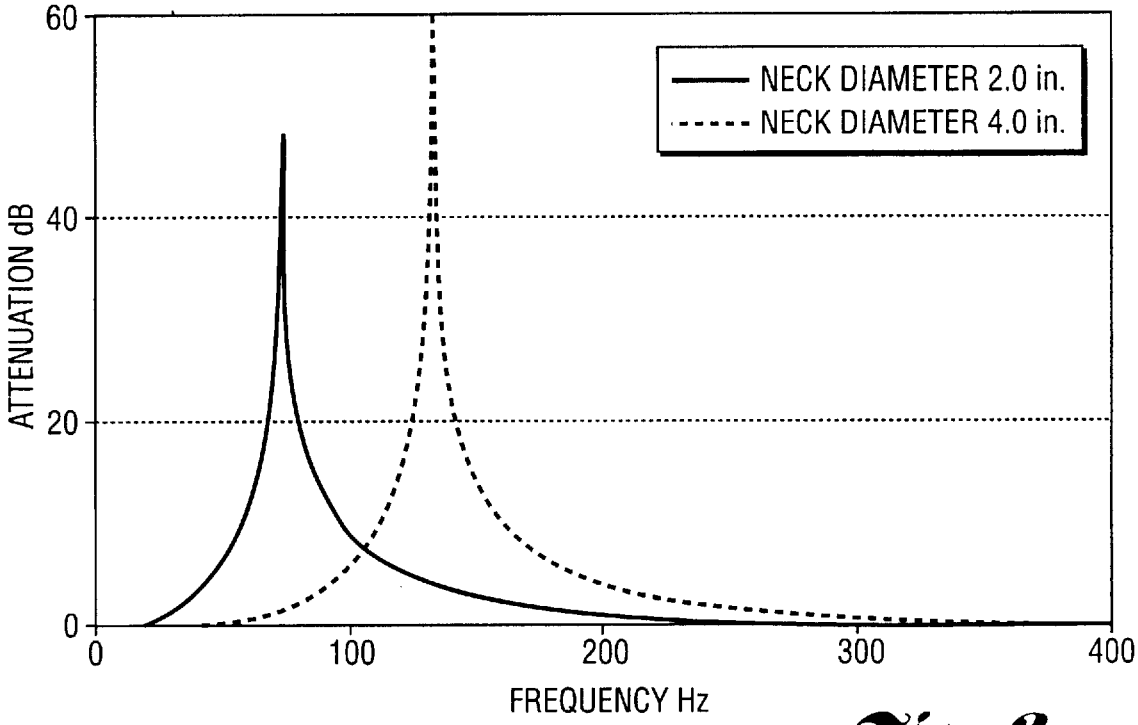
FIG. 3 is a line graph illustrating the effect of changing the neck diameter of a Helmholtz resonator on the attenuation capability of the resonator.

Changing the geometry of a Helmholtz resonator changes not only its resonant frequency, but can also change the bandwidth of attenuation of the resonator. FIG. 2 illustrates some of the important dimensions of the resonator 18 shown in FIG. 1. Increasing the neck diameter of a resonator increases the magnitude of the attenuation at the resonant frequency. It also increases the resonant frequency itself. FIG. 3 illustrates this principle using data taken from a Helmholtz resonator having a single neck. The frequency at which each of the curves peak is the resonant frequency for that particular neck diameter. The first effect of increasing the neck diameter is a resulting increase in the resonant frequency of the resonator. This principle is clearly illustrated in FIG. 3, where it is seen that the resonator with the four-inch diameter neck has significantly higher peak attenuation than the resonator with the two inch diameter neck. The second effect of increasing the neck diameter is that the magnitude of the attenuation at the resonant frequency also increases. This principle is also illustrated in FIG. 3, which shows the resonator with the four inch diameter neck having a resonant frequency of 100–200 Hz. This is in sharp contrast to the resonator with the two-inch diameter neck, which has a resonant frequency of less than 100 Hz.

Returning now to FIG. 2, it is seen that there are two diameters D and D', associated with the necks 22, 24, respectively. The two diameters D, D' will generally be equal, though they could be different to meet the needs of a particular application. Increasing the neck diameters D, D' of the resonator 18 has a similar effect as increasing the diameter of the neck in a single neck resonator. This means that if both the diameters D, D' are two inches, a plot of the attenuation of the resonator 18 would not exactly match the dotted curve shown in FIG. 3; however, such a curve would have a higher peak than the solid curve shown in FIG. 3, and such a curve would also peak at a higher frequency than the solid curve shown in FIG. 3. Thus, the same relationships between larger and smaller neck diameters hold true both for single neck resonators and dual neck resonators.

Although it is desirable to increase the magnitude of attenuation of a resonator such that loud engine noise is attenuated, the increase in the resonant frequency associated with increasing the neck diameter may be undesirable. This is because Helmholtz resonators are usually designed such that their resonant frequency equals the frequency of the target engine noise. Increasing the neck diameter often pushes the resonant frequency well beyond the low frequency engine noise targeted by the designer. One way to negate this deleterious effect, while still increasing the magnitude of attenuation resulting from increasing the neck diameter, is to increase the length of the neck.

Figure 4:
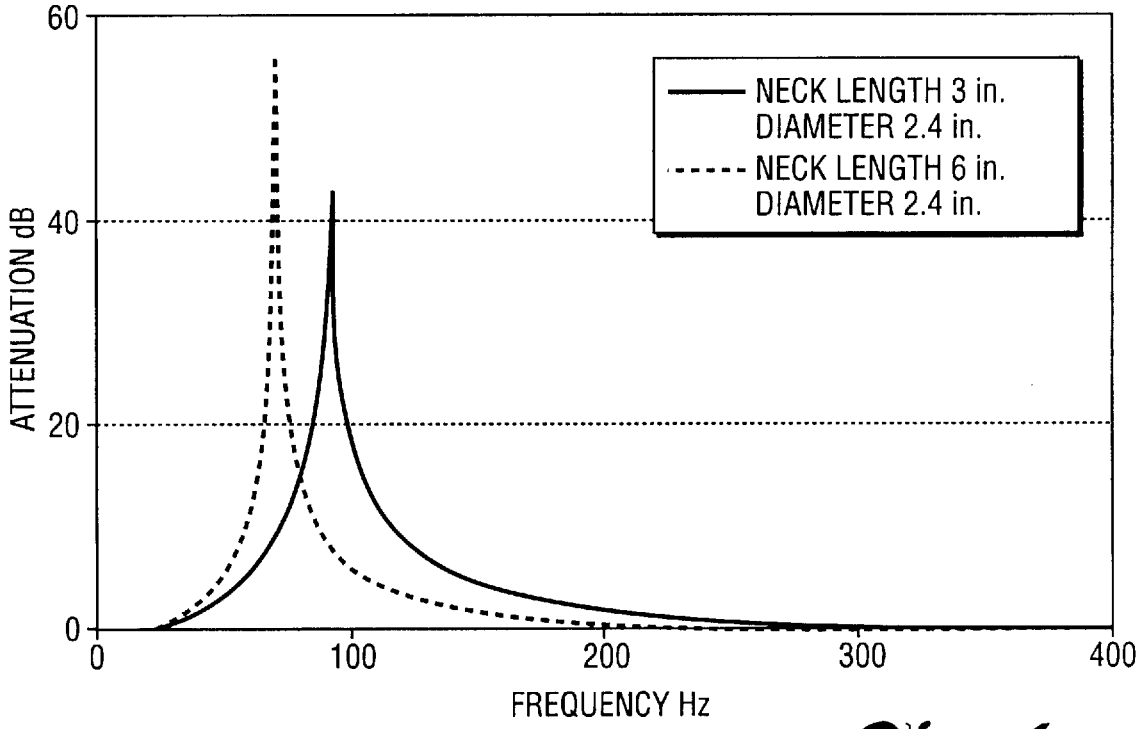
FIG. 4 is a line graph illustrating the effect of changing the neck length of a Helmholtz resonator on the attenuation capability of the resonator.

The effect of changing the neck length on the attenuation of a resonator is illustrated in FIG. 4. Here it is seen that increasing the neck length increases the magnitude of attenuation at the resonant frequency, but unlike increasing the neck diameter, increasing the neck length shifts the curve back toward the left. This means that increasing the neck length on the resonator reduces the resonant frequency of the resonator. Therefore, increasing the neck diameter in conjunction with increasing the neck length, is a method by which the magnitude of attenuation at the resonant frequency can be increased, while the resonant frequency itself remains relatively unchanged. Returning to FIG. 2, it is seen that the present invention provides the necks 22, 24 with relatively long neck lengths L, L' without increasing the space required for the resonator 18. This is accomplished by extending the necks 22, 24 into the inner space 34 of the resonator chamber 20. In this way, the present invention gains the benefit of having an increased neck length L, L' without sacrificing available space, an issue which is particularly important with smaller vehicles.

By utilizing two necks 22, 24, the resonator 18 has a distinct advantage over single neck resonators. When side-branch resonators "T" off air intake pipes, the neck diameter is limited by the diameter of the intake pipe. The resonator 18 of the present invention essentially avoids this limit by providing two necks 22, 24 instead of one. Although the diameters D, D' are each limited to the diameter of the intake pipe 12, the presence of the two necks 22, 24 creates an effective neck diameter that is larger than the diameter of the intake pipe 12. Thus, one of the primary benefits of the resonator 18 over single neck resonators is that the magnitude of attenuation at the resonant frequency can be further increased because of the larger effective diameter provided by the two necks 22, 24.

Figure 5:
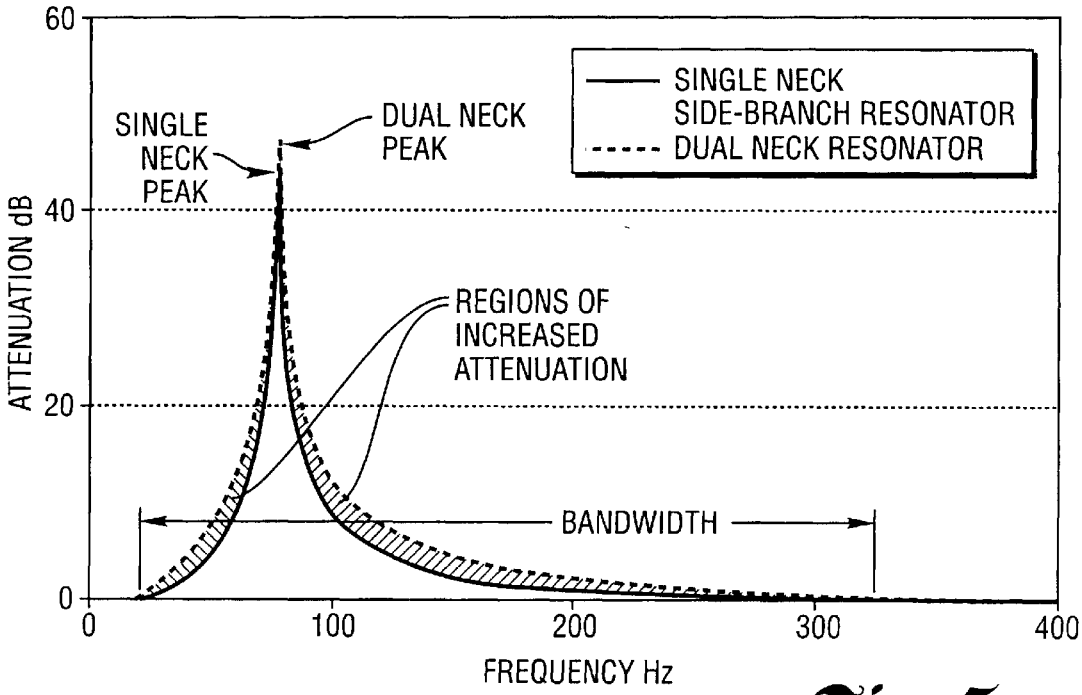
FIG. 5 is a line graph comparing the attenuation capability of a single-neck and a dual-neck Helmholtz resonator to show the effect of multiple necks on attenuation.

Another benefit of having two necks instead of one is that the bandwidth of attenuation of the resonator is also increased. This phenomenon is clearly illustrated in FIG. 5, where the solid curve represents a single neck side-branch resonator and the dotted line represents a dual neck side-branch resonator. In this graph, it is clearly seen that the dual neck resonator not only has a higher peak at the resonant frequency, but also has a broader range of frequencies that it attenuates. This range of frequencies is known as the bandwidth of attenuation of the resonator, and it is denoted as such on the graph. One of the associated benefits of an increased bandwidth of attenuation is that frequencies that were attenuated by the single neck resonator are now attenuated at a higher magnitude by the dual neck resonator. This increase in the magnitude of attenuation over a range of frequencies is illustrated in the cross-hatched areas between the two curves in FIG. 5. Thus, the resonator 18, by providing two necks 22, 24, has two distinct benefits over a single neck resonator. First, the effective diameter of the necks 22, 24 is greater than the diameter of the intake pipe 12, which results in an increase in the magnitude of attenuation at the resonant frequency. Second, the addition of a second neck increases the bandwidth of attenuation of the resonator 18, which means that the resonator 18 is much more effective than single neck resonators in attenuating a broad range of noise frequencies.

Another consideration with a dual neck resonator is the location of the two necks relative to each other. This location not only affects the fundamental bandwidth of attenuation, but also affects the resonator's ability to attenuate acoustic pressures of much higher frequency, a phenomenon discussed in more detail below. With regard to the effect of the neck location on the bandwidth of attenuation, the two necks cannot be too close to one another or the increase in bandwidth is lost. Essentially, two necks side-by-side have almost the same effect as a single neck having a large diameter. Conversely, when the distance between the two necks is too great, e.g., much greater than three times the neck diameter, the overall bandwidth of attenuation is reduced over that of a single neck resonator. Thus, there exists an optimum distance to separate the two necks of a dual neck resonator. Returning to FIGS. 1 and 2, the location of the two necks 22, 24 relative to each other and to the end walls 30, 30' is shown. In this embodiment, the diameters D and D' are equal, and the distance between the center lines of the necks 22, 24 is approximately 1.5 times that of the diameters D, D'. This allows the resonator 18 to take full advantage of the increase in bandwidth afforded by having two necks, while at the same time facilitating attenuation of acoustic pressures of higher frequencies by utilizing standing waves that form within the resonator chamber.

High frequency standing waves found within resonator chambers is a phenomenon that adds complexity to resonator design, but at the same time can be effectively utilized in tuning the resonator. Because these standing waves have much higher frequencies than the fundamental firing order noise frequencies generated by the engine, the wavelengths of the standing waves are much shorter than those of the engine firing order noise waves. A four-cylinder engine operating at a fundamental firing frequency of 100 Hz produces engine noise having wavelengths longer than 10 feet. In contrast to this, the higher frequency standing waves found within resonator chambers have wavelengths in the range of the resonator system dimensions. In the case of a resonator used on a four-cylinder engine, some standing waves may have wavelengths of about 12–15 inches, the length of the resonator chamber, or some may be 3 to 6 inches in length, corresponding to the width and height of the resonator chamber. There may be still other high frequency standing waves within the chamber that have even shorter wavelengths.

Figure 6:
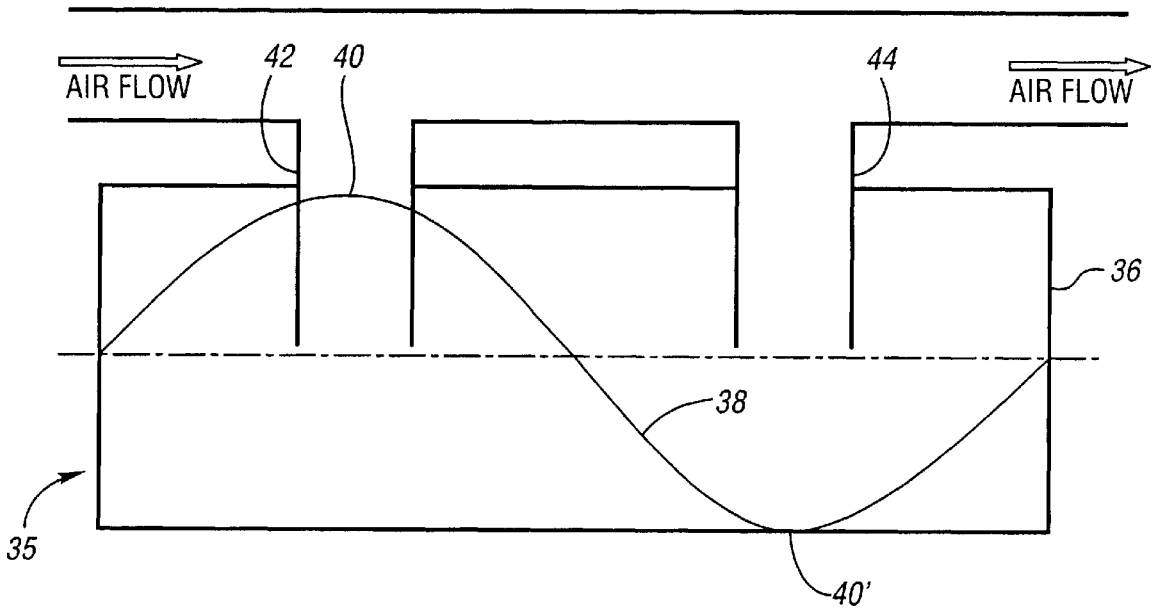
FIG. 6 is a fragmentary schematic cross-section showing a higher frequency resonator chamber standing wave.

Because these higher frequency waves have wavelengths on the order of the resonator chamber dimensions, it is possible to locate a neck at or near an anti-node of some of these waves. This is important since acoustic pressure is a maximum at the anti-nodes, and a minimum at the nodes. Locating a neck near an anti-node results in a more effective utilization of the standing wave in attenuating high frequency engine noise. By providing two necks on the resonator chamber, the number of standing wave anti-nodes near a neck is necessarily increased. FIG. 6 illustrates a resonator 35 having a resonator chamber 36. Within the chamber 36 is a standing wave 38 that has anti-nodes 40 and 40'. It is understood that many standing waves of different frequencies (and therefore different wavelengths) are present in various locations throughout the chamber 36. FIG. 6 illustrates an optimum situation, where two necks 42 and 44 are located at the two anti-nodes 40, 40' of the standing wave 38. The positioning of the necks 42, 44 will not be optimum for all the standing waves within the chamber 36, but having two necks instead of one increases the number of standing wave anti-nodes at or near the necks, and provides greater flexibility in tuning a resonator for a particular application. The net result is a more effective utilization of standing waves for acoustic pressure attenuation.

Figure 7:
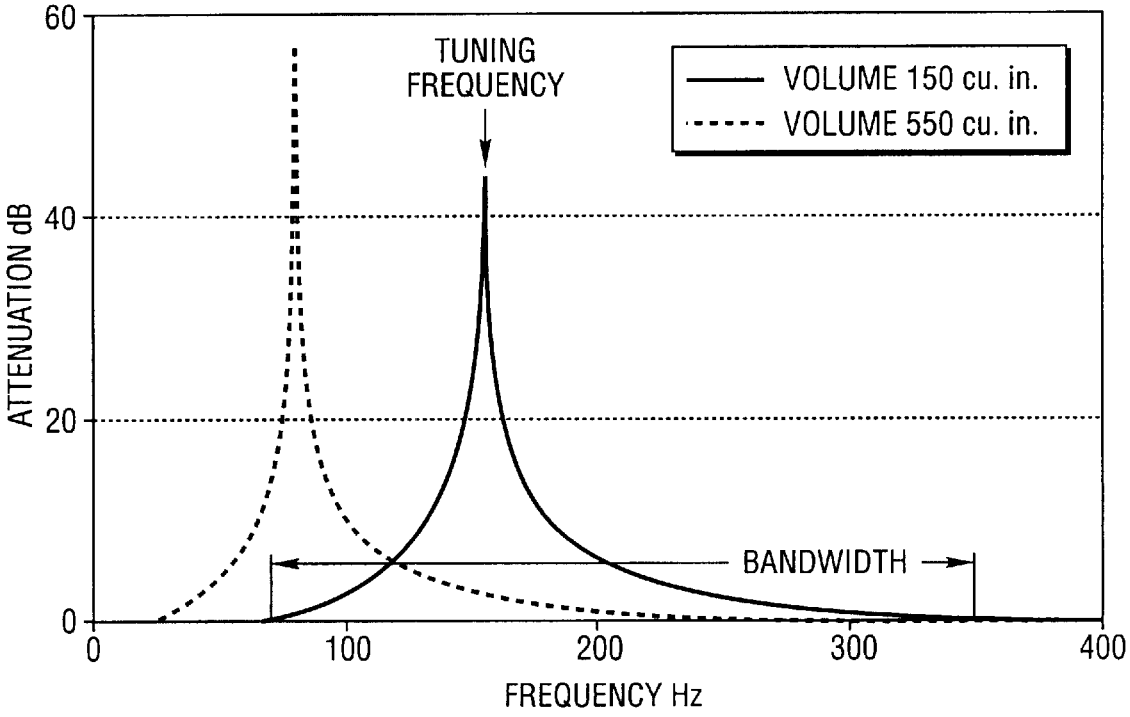
FIG. 7 is a line graph illustrating the effect of changing the chamber volume of a Helmholtz resonator on the attenuation capability of the resonator.

Aside from changing the dimensions of the neck in a Helmholtz resonator, one of the primary methods by which resonant frequencies are adjusted is by changing the volume of the resonator chamber. FIG. 7 illustrates the effect of changing the resonator volume on attenuation in a Helmholtz resonator. Here it is seen that an increase in resonator volume increases the magnitude of attenuation at the resonant frequency and decreases the resonant frequency itself. Although this may be desirable, it is often impracticable as vehicle packaging considerations may limit the maximum size of the resonator chamber. This is why it is especially important in smaller vehicles to provide a resonator that maximizes noise attenuation by means other than increasing the volume of the resonator chamber. The present invention provides just such flexibility. The resonator 18 has two necks 22, 24 with diameters D, D' that can be both be increased to increase the effective neck diameter. As previously discussed, this increases the magnitude of attenuation at the resonant frequency beyond that of a single neck resonator. In addition, the length of the two necks 22, 24 can be adjusted to change the attenuation characteristics of the resonator 18. Usually this involves increasing the neck lengths to lower the resonant frequency, but the lengths can be shortened if a higher frequency noise is targeted. Finally, the distance between the two necks 22, 24 can be adjusted to optimize low frequency engine noise attenuation as well as some higher frequency noise attenuation. Thus, the present invention provides flexibility not found in a single neck resonator.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A dual neck noise attenuation apparatus for attenuating noise from an engine having a fluid-carrying conduit, comprising:

a resonator chamber; and two connecting tubes adapted for disposition between the fluid-carrying conduit and the resonator chamber, the presence of both tubes creating an effective tube diameter larger than the fluid-carrying conduit, for facilitating sound transfer between the fluid-carrying conduit and the chamber.

2. The noise attenuation apparatus of claim 1, wherein the apparatus includes the fluid-carrying conduit, and the fluid-carrying conduit is a generally cylindrical air intake pipe.

3. The noise attenuation apparatus of claim 2, wherein the two connecting tubes comprises a first neck and a second neck, each neck being generally cylindrical and having an inlet end and a chamber end.

4. The noise attenuation apparatus of claim 3, wherein the two necks are approximately normal to the intake pipe, generally parallel to each other, and the inlet ends are generally flush with the inside wall of the pipe.

5. The noise attenuation apparatus of claim 3, wherein the length of the two necks is approximately equal, and the chamber ends extend into the resonator chamber.

6. The noise attenuation apparatus of claim 1, wherein the resonator chamber is generally rectangular.

7. A noise attenuation apparatus for attenuating noise from an engine having a fluid-carrying conduit, comprising:

a resonator chamber; and a plurality of connecting tubes adapted for disposition between the fluid-carrying conduit and the resonator chamber for facilitating sound transfer between the fluid-carrying conduit and the chamber;

wherein the apparatus includes the fluid-carrying conduit, and the fluid-carrying conduit is a generally cylindrical air intake pipe;

wherein the plurality of connecting tubes comprises a first neck and a second neck, each neck being generally cylindrical and having an inlet end and a chamber end; and wherein the diameter of each neck approximately equals the diameter of the intake pipe.

8. A noise attenuation apparatus for attenuating noise from an engine having a fluid-carrying conduit, comprising:

a resonator chamber; and a plurality of connecting tubes adapted for disposition between the fluid-carrying conduit and the resonator chamber for facilitating sound transfer between the fluid-carrying conduit and the chamber;

wherein the apparatus includes the fluid-carrying conduit, and the fluid-carrying conduit is a generally cylindrical air intake pipe;

wherein the plurality of connecting tubes comprises a first neck and a second neck, each neck being generally cylindrical and having an inlet end and a chamber end; and wherein the distance between the necks is less than three times the neck diameter.

9. An induction system resonator for attenuating noise from an engine having an air intake pipe, comprising:

a resonator chamber; and two connecting tubes of approximately equal length, each tube including an intake end adapted for opening into the intake pipe, and a chamber end opening into the resonator chamber, the presence of both tubes creating an effective tube diameter larger than the fluid-carrying conduit.

10. The resonator of claim 9, wherein the chamber ends extend into the resonator chamber.

11. The resonator of claim 9, wherein two connecting tubes comprise two generally cylindrical necks parallel to each other and adapted to be approximately normal to the intake pipe.

12. The resonator of claim 9, wherein the resonator chamber comprises walls orthogonally oriented to each other.

13. An induction system resonator for attenuating noise from an engine having an air intake pipe, comprising:

a resonator chamber; and a plurality of connecting tubes of approximately equal length, each tube including an intake end adapted for opening into the intake pipe, and a chamber end opening into the resonator chamber;

wherein the plurality of connecting tubes comprises two generally cylindrical necks parallel to each other and adapted to be approximately normal to the intake pipe; and wherein the necks have a centerline separation less than three times the neck diameter.

14. A method of attenuating noise from an engine having a fluid-carrying conduit using a noise attenuation apparatus, comprising:

providing a resonator chamber with a generally cylindrical first tube disposed between the resonator chamber and the fluid carrying conduit for attenuating the engine noise; and tuning the noise attenuating apparatus to target specific engine noise frequencies by providing the resonator chamber with a generally cylindrical second tube having a length approximately equal to the first tube, and disposed between the resonator chamber and the fluid-carrying conduit at a certain distance from the first tube, the presence of both tubes creating an effective tube diameter larger than the fluid-carrying conduit.

15. The method of claim 14, wherein tuning the noise attenuating apparatus further comprises disposing one end of both tubes within the resonator chamber.

16. The method of claim 14, wherein tuning the noise attenuation apparatus comprises providing the second tube with a different diameter than the first tube.

17. A method of attenuating noise from an engine having a fluid-carrying conduit using a noise attenuation apparatus, comprising:

providing a resonator chamber with a generally cylindrical first tube disposed between the resonator chamber and the fluid-carrying conduit for attenuating the engine noise; and tuning the noise attenuating apparatus to target specific engine noise frequencies by providing the resonator chamber with a generally cylindrical second tube having a length approximately equal to the first tube, and disposed between the resonator chamber and the fluid-carrying conduit at a certain distance from the first tube; and wherein tuning the noise attenuating apparatus further comprises providing the second tube with the same diameter as the first tube, and locating the second tube substantially parallel to the first tube with a centerline separation less than three times the neck diameter.

* * * * *